US010406050B2

(12) United States Patent
Reinke et al.

(10) Patent No.: US 10,406,050 B2
(45) Date of Patent: Sep. 10, 2019

(54) OCCUPANT SUPPORT WITH A KNEE LIFT

(71) Applicants: Christian H. Reinke, York, SC (US); Lindsey M. Gault, Cincinnati, IN (US); Jonathan D. Turner, Dillsboro, IN (US)

(72) Inventors: Christian H. Reinke, York, SC (US); Lindsey M. Gault, Cincinnati, IN (US); Jonathan D. Turner, Dillsboro, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 1074 days.

(21) Appl. No.: 13/917,809

(22) Filed: Jun. 14, 2013

(65) Prior Publication Data

US 2013/0333114 A1 Dec. 19, 2013

Related U.S. Application Data

(60) Provisional application No. 61/661,102, filed on Jun. 18, 2012.

(51) Int. Cl.

| | |
|---|---|
| ***A61G 7/002*** | (2006.01) |
| ***A61G 7/015*** | (2006.01) |
| ***A47C 20/04*** | (2006.01) |

(52) U.S. Cl.

CPC ..... *A61G 7/002* (2013.01); *A61G 7/015* (2013.01); *A47C 20/048* (2013.01)

(58) Field of Classification Search

CPC ..... A61G 7/002; A61G 7/015; A61G 7/018; A47C 20/048; A47C 20/021; A47C 20/04; A47C 20/10; A47C 20/12

See application file for complete search history.

(56) References Cited

U.S. PATENT DOCUMENTS

| | | | | |
|---|---|---|---|---|
| 2,306,239 | A * | 12/1942 | Woller | A61G 7/015 5/617 |
| 2,337,284 | A * | 12/1943 | Urie | A61G 7/015 5/618 |
| 2,349,701 | A * | 5/1944 | Buttikofer | A47C 20/041 5/616 |
| 2,605,481 | A * | 8/1952 | Burkhart | A47C 20/041 192/69.81 |
| 2,747,203 | A * | 5/1956 | Dawson | A61G 7/015 5/616 |
| 2,917,753 | A | 12/1959 | Portis et al. | |
| 3,191,196 | A * | 6/1965 | Holm | A47C 20/041 297/330 |

(Continued)

FOREIGN PATENT DOCUMENTS

GB 1108472 A 4/1968

OTHER PUBLICATIONS

Partial EP Search Report for EP1317228; Place of Search—The Hague; Date of Completion of the Search—Sep. 12, 2013.

(Continued)

*Primary Examiner* — Nicholas F Polito
(74) *Attorney, Agent, or Firm* — Kenneth C. Baran

(57) ABSTRACT

An occupant support comprises a frame (30), a deck comprising at least one deck section (20, 22, 24, 26) pivotably connected to the frame, and a lift system (60) for changing the angular orientation of the deck section in response to a noncyclical user input.

14 Claims, 10 Drawing Sheets

(56) References Cited

U.S. PATENT DOCUMENTS 3,201,806 A * 8/1965 Hutt ..... A61G 7/002 5/614
3,261,639 A * 7/1966 Phillips ..... A47C 20/08 297/321
4,344,422 A * 8/1982 Immel ..... A61G 7/05 5/109
4,731,888 A * 3/1988 Bridges ..... A47C 17/17 5/18.1
5,160,010 A * 11/1992 Peterson ..... A47C 19/045 188/67
5,438,723 A * 8/1995 Carroll ..... A47C 19/122 16/267
5,537,701 A * 7/1996 Elliott ..... A47C 19/005 5/616
5,584,082 A * 12/1996 Crawford ..... A61G 7/015 297/344.17
6,272,702 B1 * 8/2001 Uchida ..... A61G 5/006 5/600
6,347,420 B2 * 2/2002 Elliott ..... A61G 5/006 5/613
6,619,748 B1 * 9/2003 Tseng ..... A47C 1/0347 297/423.3
6,789,280 B1 * 9/2004 Paul ..... A61G 7/012 5/425
2010/0122415 A1 * 5/2010 Turner ..... A61G 7/015 5/618
2010/0251483 A1 * 10/2010 Shimada ..... A47C 20/043 5/613
2010/0257671 A1 * 10/2010 Shimada ..... A47C 19/04 5/611
2013/0333114 A1 * 12/2013 Reinke ..... A61G 7/015 5/600
2014/0304916 A1 * 10/2014 Guo ..... A61G 7/015 5/616
2014/0325759 A1 * 11/2014 Bly ..... A61G 7/002 5/611
2015/0182398 A1 * 7/2015 Hollyoak ..... A61G 7/015 5/613

OTHER PUBLICATIONS

Search Opinion Response filed for EP Application 13172228.2 dated Sep. 5, 2014.
Claims as filed (Tracked) for EP Application 13172228.2.
Claims as filed (Final) for EP Application 13172228.2.
Amended pages as filed (Tracked) for EP Application 13172228.2.
Amended pages as filed (Final) for EP Application 13172228.2.
Response sent to EPO dated Jun. 26 for Feb. 23, 2015 Office Action for EP Application 13172228.2.
Amended Description with tracking sent to EPO dated Jun. 26 for Feb. 23, 2015 Office Action for EP Application 13172228.2.
Amended Claims with tracking sent to EPO dated Jun. 26 for Feb. 23, 2015 Office Action for EP Application 13172228.2.
Clean Amended Description sent to EPO dated Jun. 26 for Feb. 23, 2015 Office Action for EP Application 13172228.2.
Clean Amended Claims sent to EPO dated Jun. 26 for Feb. 23, 2015 Office Action for EP Application 13172228.2.
Communication pursuant to Article 94(3) dated Feb. 23, 2015, Mar. 2, 2015 for EP Application 13172228.2.

* cited by examiner

OCCUPANT SUPPORT WITH A KNEE LIFT

TECHNICAL FIELD

The subject matter described herein relates to occupant supports such as hospital beds and stretchers and particularly to an occupant support having at least one deck section which is adjustable in angular orientation by way of a simple user input.

BACKGROUND

Occupant supports such as stretchers include a frame and a deck assembly supported on the frame. In some occupant supports the deck assembly includes two or more deck sections, at least one of which can be oriented to an angular orientation most suitable for the occupant of the stretcher. In one example a stretcher includes an orientation adjustable thigh section and an orientation adjustable calf section whose orientation is a function of the orientation of the thigh section. Various mechanical arrangements have been used to effect the orientation adjustment. Nevertheless, manufacturers continue to seek alternatives that are reliable, simple, and easy to use.

SUMMARY

An occupant support comprises a frame, a deck comprising at least one deck section pivotably connected to the frame, and a lift system for changing the angular orientation of the deck section in response to a noncyclical user input.

BRIEF DESCRIPTION OF THE DRAWINGS

The foregoing and other features of the various embodiments of the occupant support described herein will become more apparent from the following detailed description and the accompanying drawings in which:

In FIG. 5 the calf deck section has been removed for clarity.

In FIG. 8 the calf deck section has been removed for clarity

DETAILED DESCRIPTION

Figure 1:
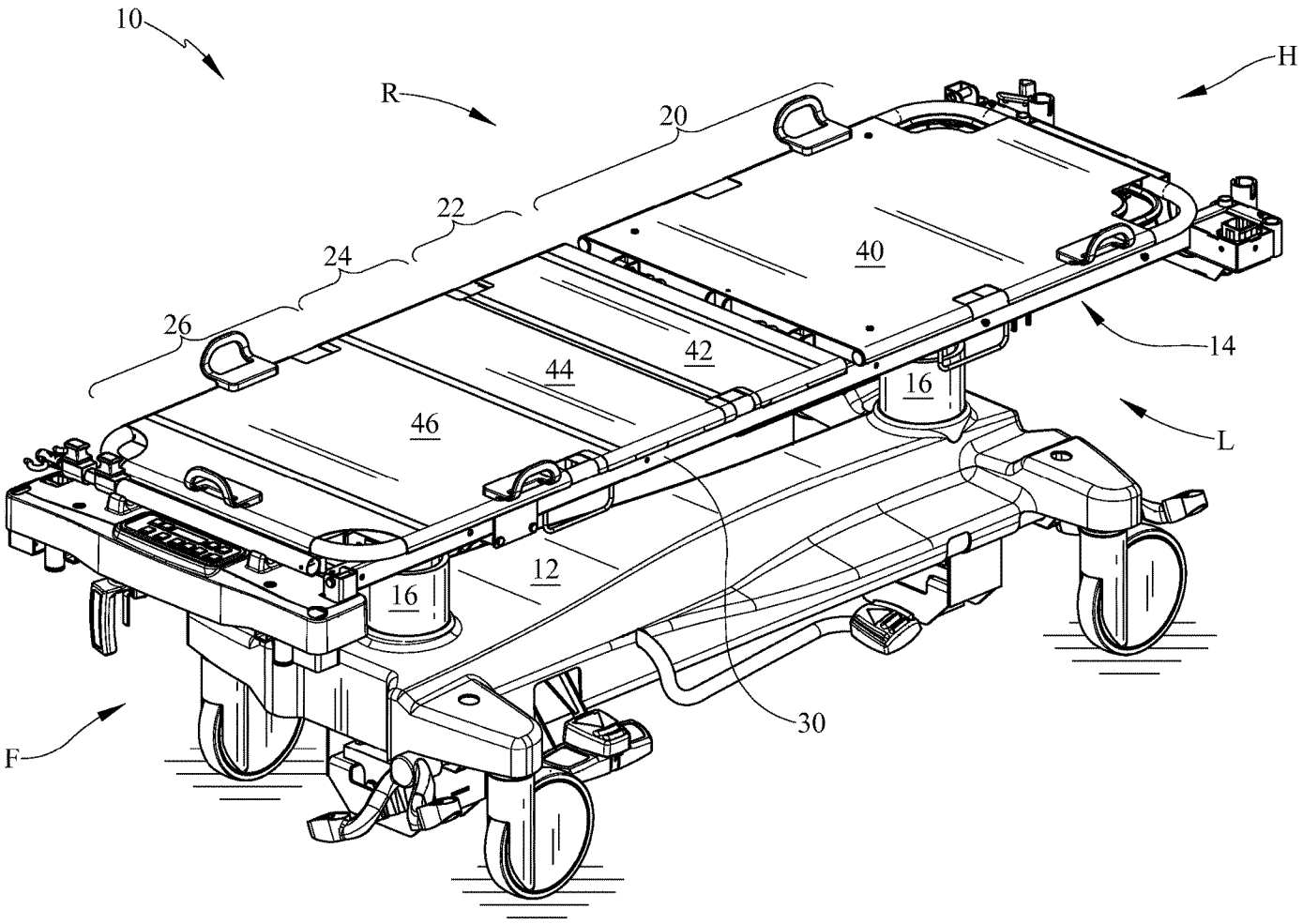
FIG. 1 is a perspective view of a stretcher.
Figure 2:
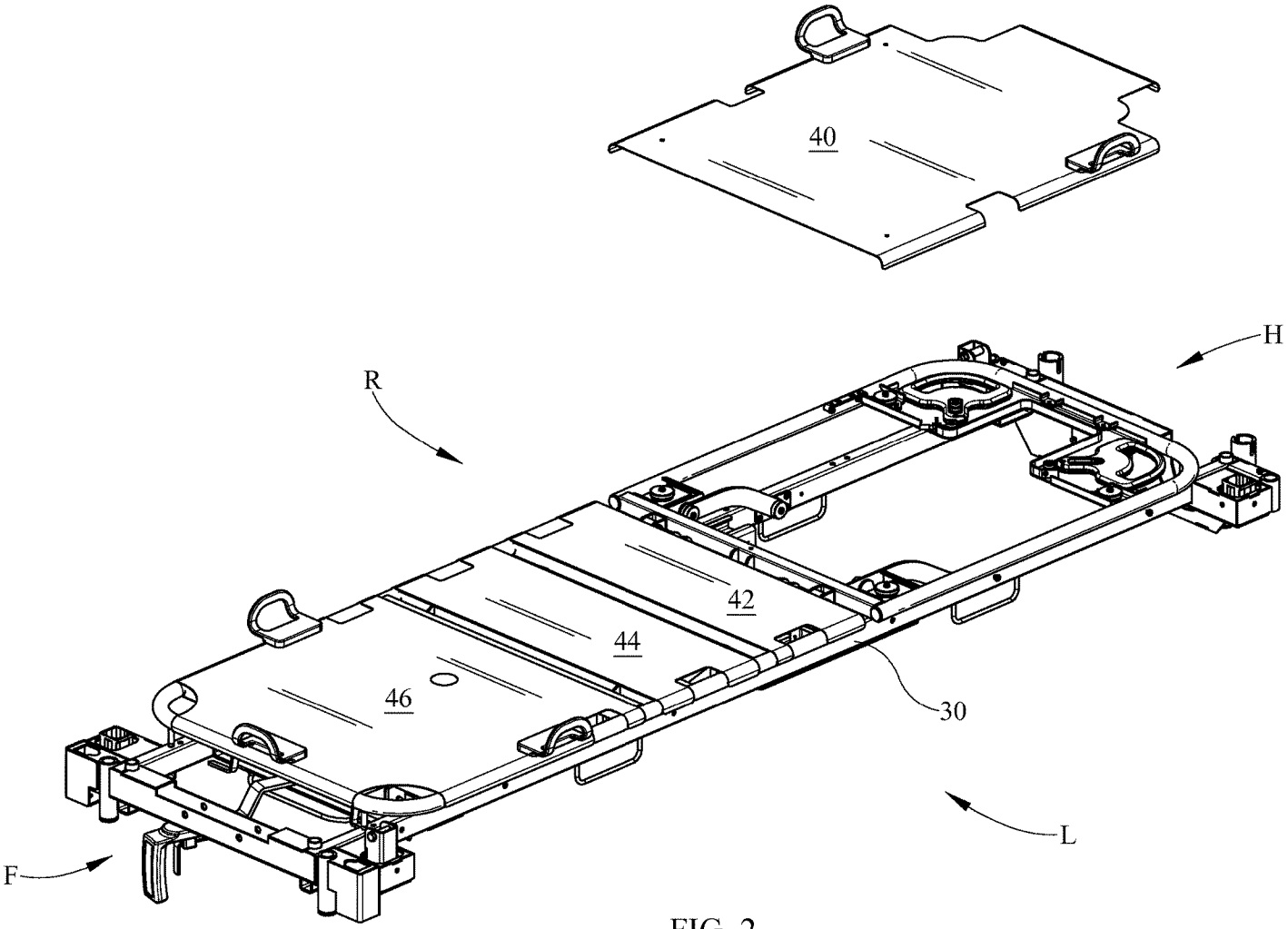
FIG. 2 is a perspective view of the deck of the stretcher of FIG. 1 showing a removable deck panel.

FIGS. 1-2 show a stretcher 10 which extends longitudinally from a head end H to a foot end F and laterally from a left side L to a right side R. The stretcher includes a base frame 12 and a deck assembly 14 supported on the base frame by, for example, lift columns 16. The deck assembly comprises at least one deck section. The illustrated stretcher has four deck sections, an upper body or torso section 20 corresponding approximately to the torso of an occupant of the stretcher, a seat section 22 corresponding approximately to the occupant's buttocks, a thigh section 24 corresponding approximately to the occupant's thighs and a calf section 26 corresponding approximately to the occupant's calves and feet. The deck assembly includes a deck frame 30 and a set of four panels 40, 42, 44, 46 supported on the deck frame, one panel corresponding to each of the upper body, seat, thigh and calf sections. Deck panel 40 is removable from the frame; the other deck panels are nonremovable.

As seen best by comparing FIGS. 3 and 5 to FIGS. 4 and 6 a first deck section, specifically thigh deck section 24 is pivotably connected to deck frame 30 and is pivotable relative to frame 30 about axis 50. Continuing to refer to FIGS. 3 and 6, a second deck section, specifically calf deck section 26, is pivotably connected to the first deck section for rotation about axis 52 such that a change of angular orientation of the first deck section causes a change of angular orientation of the second deck section.

The stretcher also includes a knee lift system 60 for changing the angular orientation of the thigh deck section. The change of orientation of the thigh deck section is effected by a noncyclical user input to the lift system. The user input is a mechanical input, i.e. one produced by the user's direct application of physical force to the lift system, as opposed to, for example, a user closing a switch to energize an electric motor. Nevertheless, the lift system may be arranged so that the physical force applied by the user is amplified by leverage or other forms of mechanical advantage.

Figure 3:
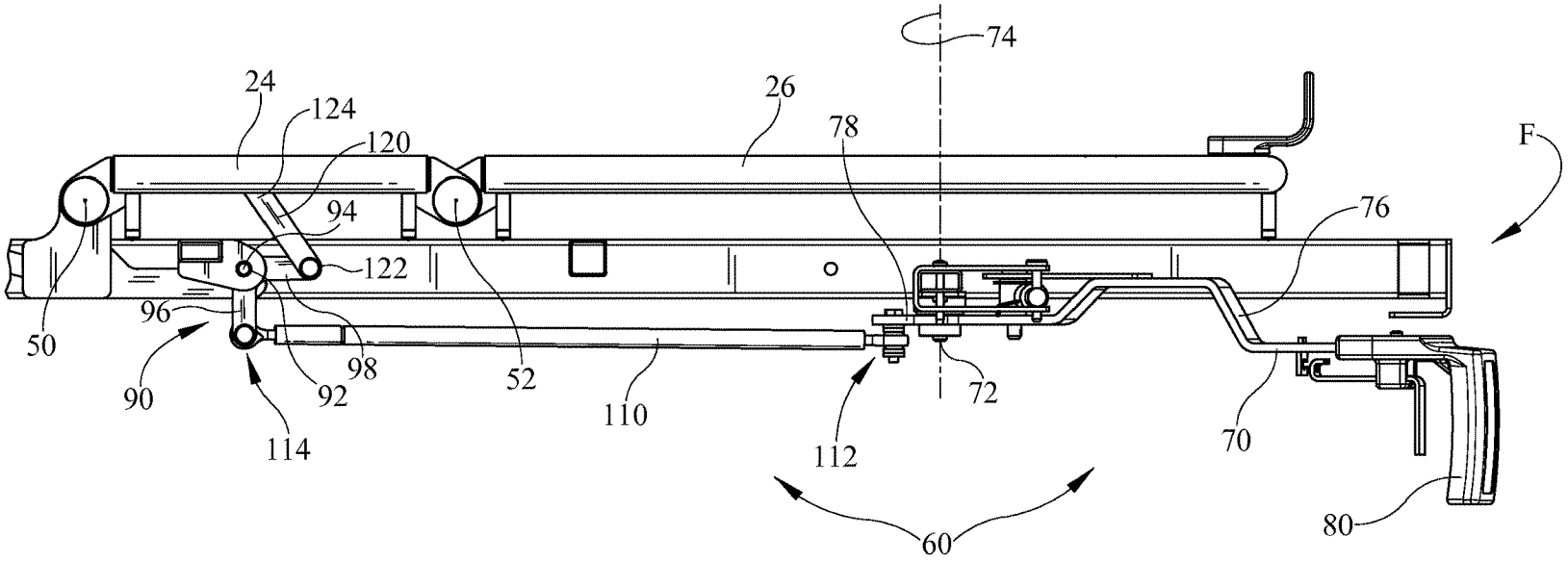
FIGS. 3-5 are a side elevation view, a plan view and a perspective view respectively of a portion of a stretcher described herein showing a section of the stretcher deck at an angular orientation of 0° and a lift system for changing the orientation.

Referring to FIGS. 1-3 the lift system comprises a first bellcrank 70 pivotably attached to frame 30 at pivot joint 72 for rotation about a vertical axis of rotation 74. Bellcrank 70 has an input arm 76 for receiving a user input and an output arm 78. A handle assembly 80 is affixed to the input arm so that a user can move the arm horizontally through an angular arc of about 44°.

The lift system also includes second bellcrank 90 pivotably attached to frame 30 at pivot joint 92 for rotation about a horizontal axis of rotation 94. The second bellcrank has an input leg 96 and an output leg 98. A transfer link 110 has an input end 112 connected to the output arm 78 of the first bellcrank and an output end 114 connected to the input leg 96 of the second bellcrank. A compression link 120 has a bellcrank end 122 connected to output leg 98 of the second bellcrank and a deck end 124 connected to the thigh deck section 24.

In operation a user moves handle 80 by spatially displacing it toward the left side of the stretcher to increase the angular orientation of thigh deck section. Because of the pivotable connection of the calf deck section to the thigh deck section the calf deck section angular orientation also increases. Movement of the handle toward the right side of the stretcher decreases the angular orientation of thigh deck section and the calf deck section. The deck sections are movable from a flat or horizontal orientation seen in FIGS. 3-5 to a maximum inclination as seen in FIGS. 6-8.

Figure 9:
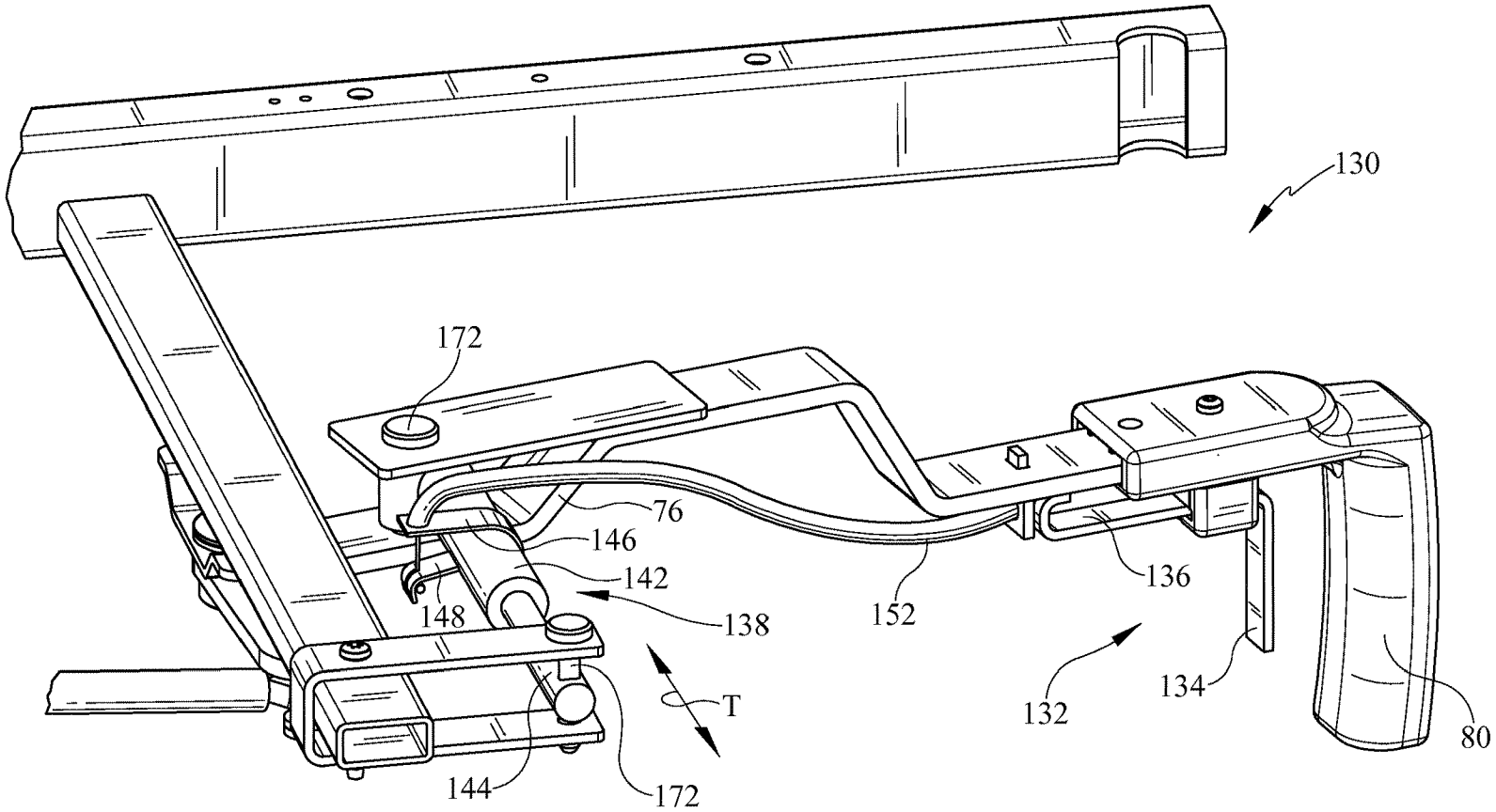
FIG. 9 is a view showing a lock for holding the deck section at a desired angular orientation.
Figure 10:
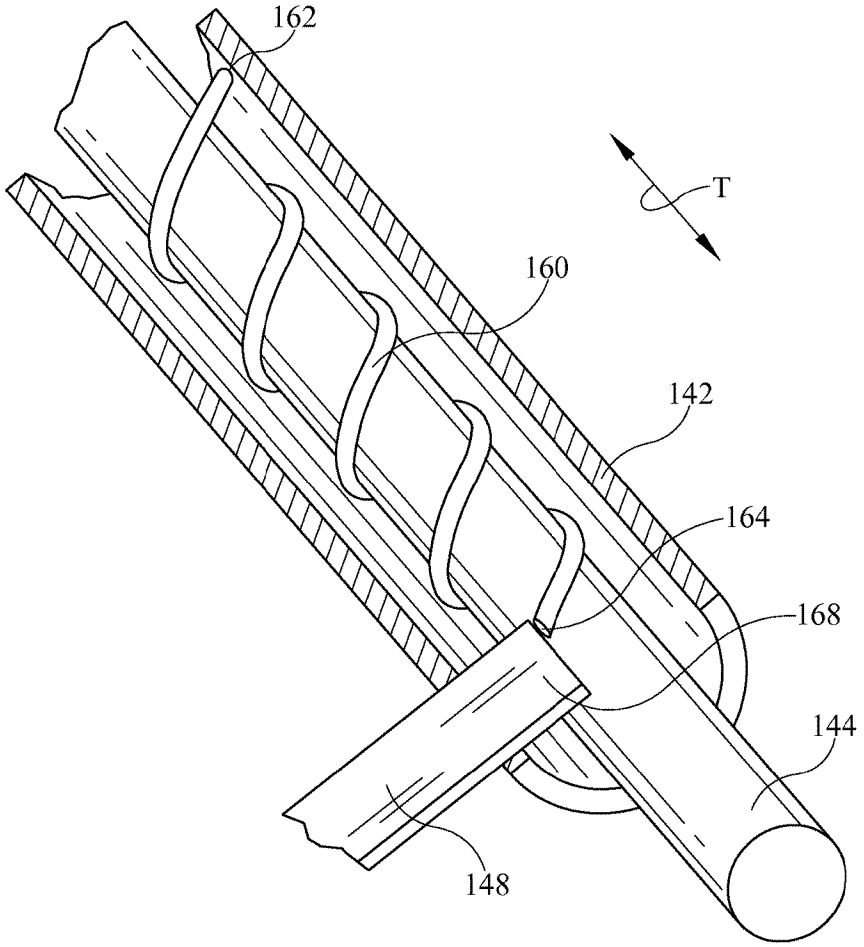
FIG. 10 is a perspective view showing the lock of FIG. 9 with a cylinder component thereof cutaway to reveal a coil spring gripping a piston component of the lock

FIGS. 9 and 10 show a lock 130 for holding the deck section at a desired angular orientation. Other means for locking may also be employed. The lock includes a trigger 132 having an operator end 134 and a remote end 136. A variable length link 138 comprises a cylinder 142 pivotably attached to the input arm 76 of bellcrank 70 and a piston 144 extending into the cylinder and pivotably connected to deck frame 30. A coil spring 160 is wrapped around the piston internal to the cylinder. A remote end 162 of the spring is mechanically grounded to the inside of the cylinder. The other end of the spring is a proximate end 164. A cable guide 146 is welded to the cylinder. A movable actuator tab 148 projects out of the cylinder. An interior end 168 of tab 148 and the proximate end 164 of the spring are arranged such that the tab can act on the proximate end of the spring. FIG. 10 shows a locked configuration in which the spring is tightly coiled around piston 144 thereby resisting translation of the piston relative to the cylinder in direction T. A cable 152 extends from the remote end of the trigger, through the cable guide, and to the actuator tab. To unlock the lock a user pulls operator end 134 of trigger 132 toward handle 80, cable 152 moves tab 148 thereby causing tab inner end 168 to exert a tangentially directed force against the proximate end of the spring. The force untightens the spring so that it releases its grip on the piston enough to allow the piston to translate in direction T relative to the cylinder without exertion of undue force by the user. A user can then swing first bellcrank 70 along an arc toward the left or right lateral sides of the stretcher. When the user releases the trigger the lock returns to its locked position to resist further change in the orientation of the deck section. Other types of locks such as a locking gas spring similarly actuated by a cable may also be used. For example a locking gas spring may be connected to the frame and the first bellcrank 70 at pin joints 172, similar to the way the piston and cylinder is connected to the frame and first bellcrank. The locking gas spring not only provides a locking feature, but also assists the user in increasing the angular orientations of deck sections 24, 26 and helps resist an abrupt decrease in the angular orientations of those deck sections when the gas spring is is unlocked.

Figure 4:
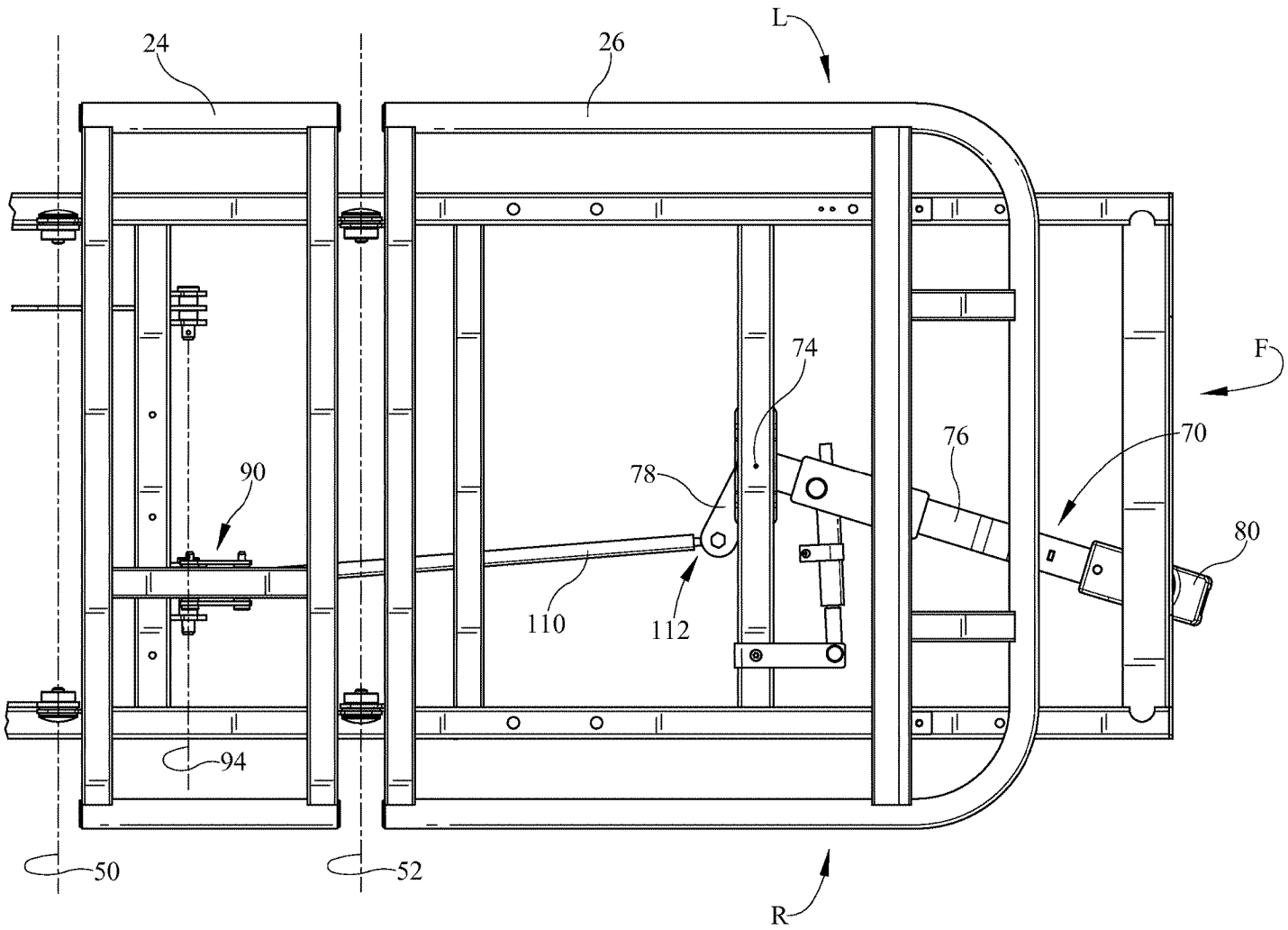
Figure 5:
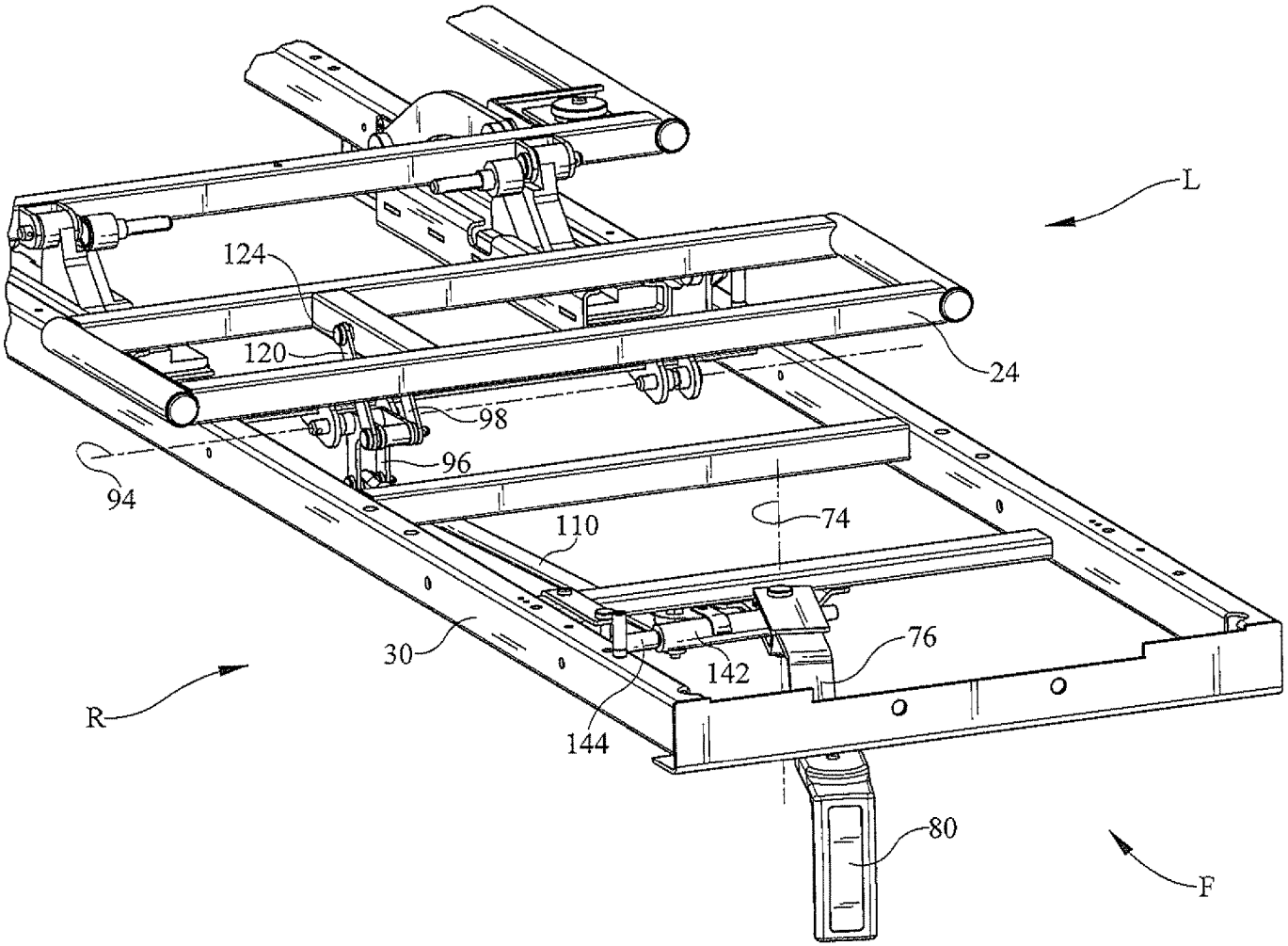
Figure 6:
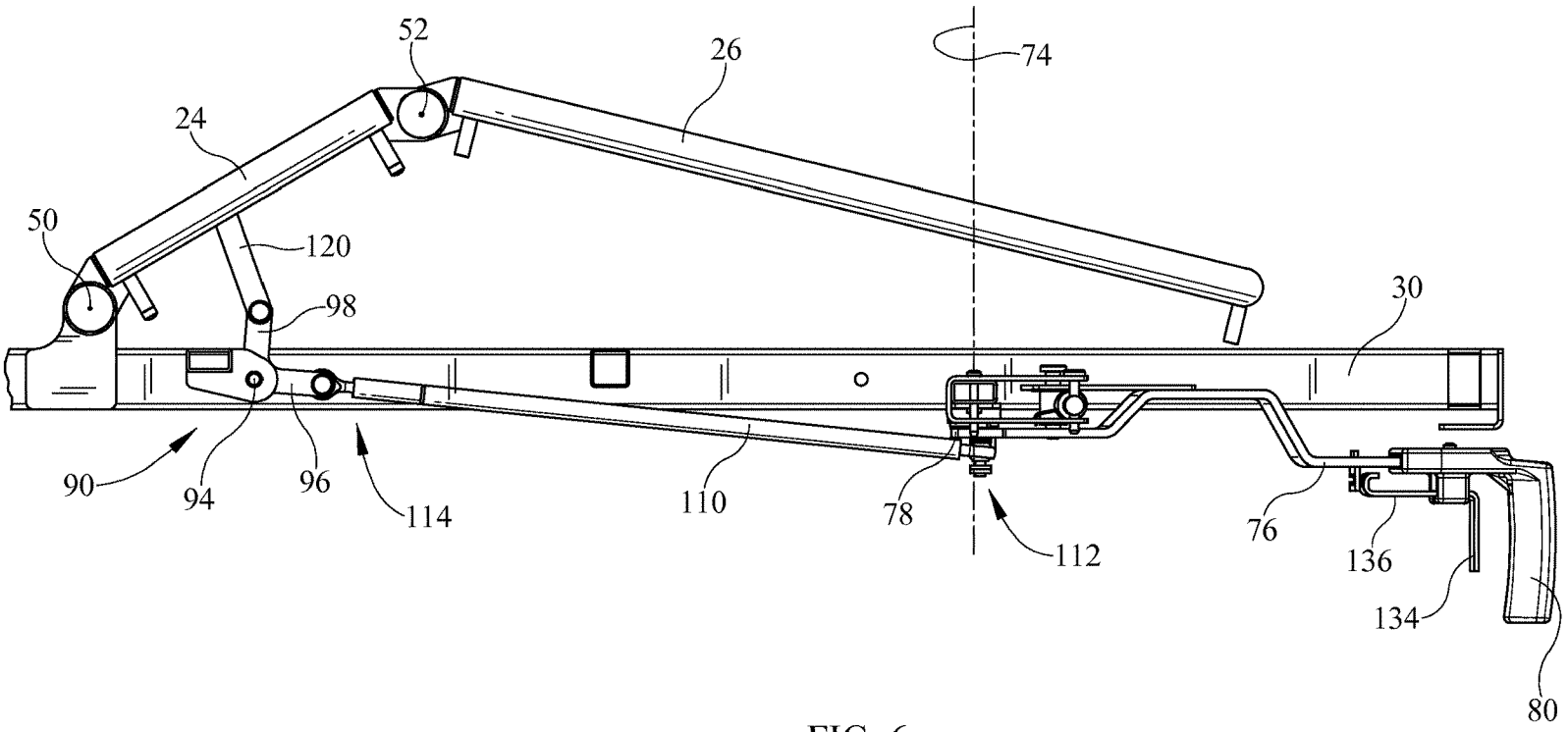
FIGS. 6-8 are views similar to those of FIGS. 1-3 showing the deck section at an angular orientation of 30°.
Figure 7:
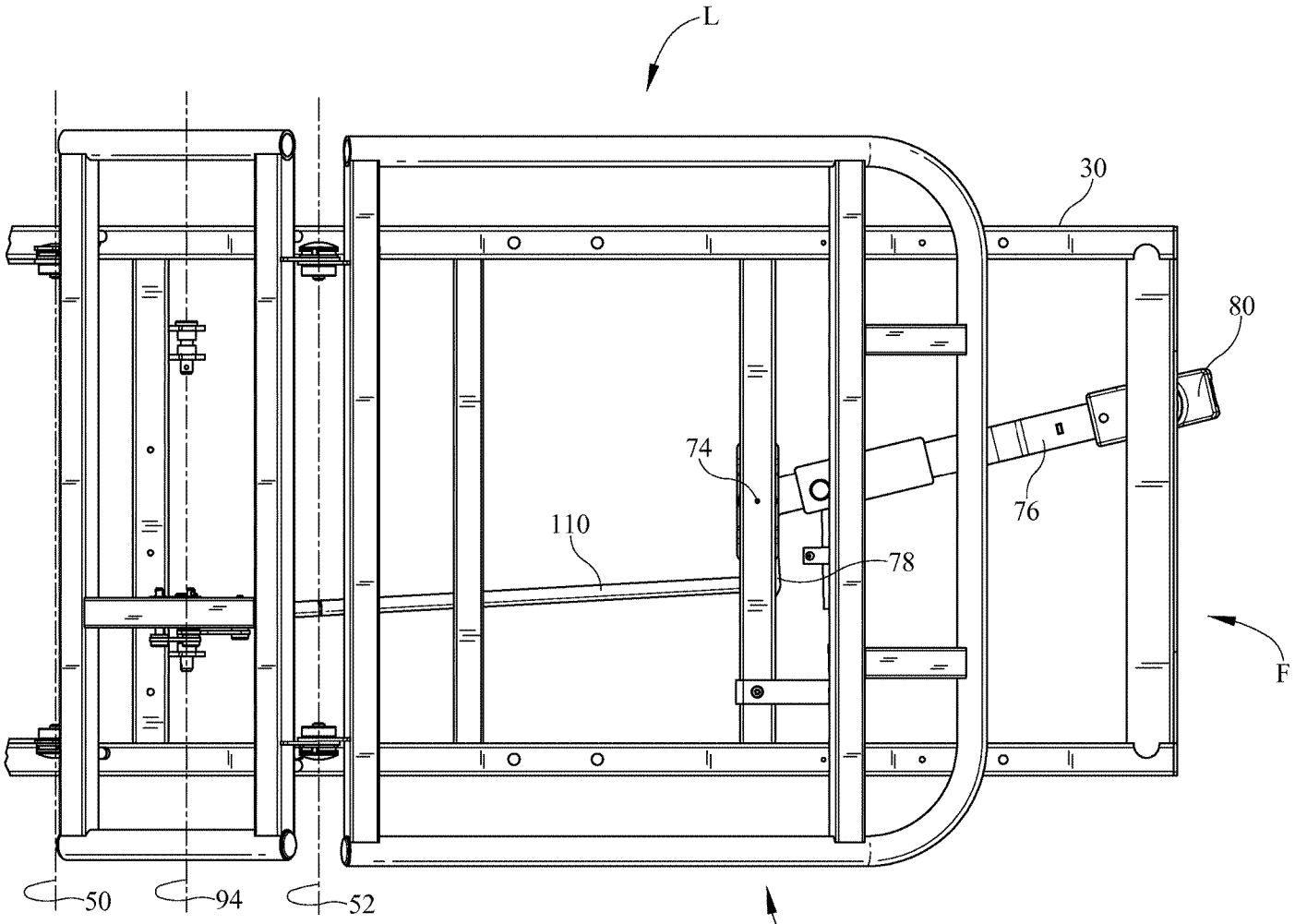
Figure 8:
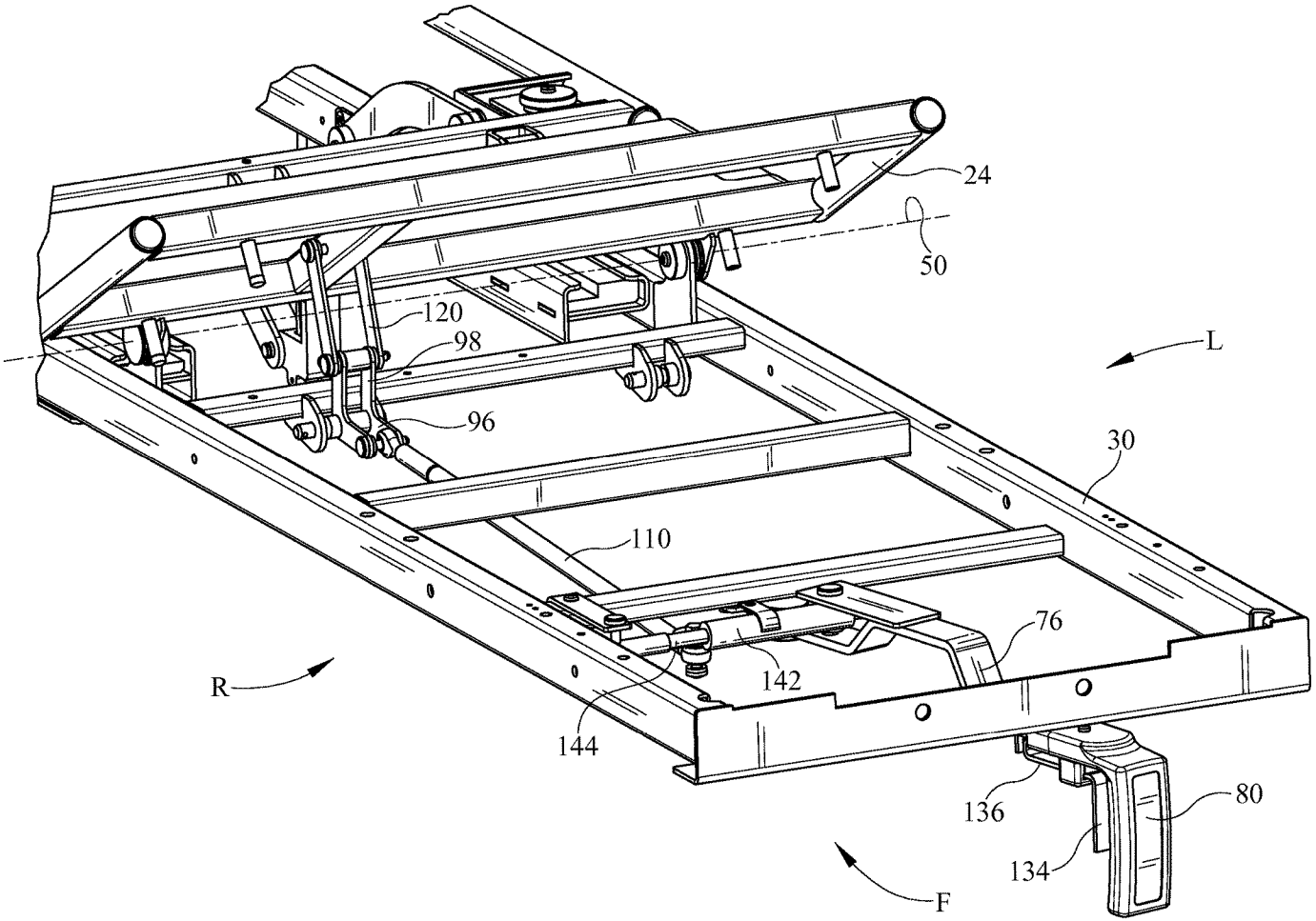

When the lock is unlocked a user may move bellcrank arm 76 away from the position of FIGS. 3-5 and toward the position of FIGS. 6-8 to increase the orientation of the thigh and calf deck sections. The bellcrank rotates about axis 74 so that bellcrank output leg 78 pulls transfer link 110 footwardly. This, in turn, rotates second bellcrank 90 about axis 94 thereby urging compression link 120 to push against the frame of deck section 24 and increase its angular orientation, along with the angular orientation of calf deck section 26. To decrease the angular orientations of the deck sections the user need only rotate bellcrank arm 76 toward the right.

Although the illustrated occupant support employs a horizontally movable handle 80, a handle moveable in other directions, such as vertical, may be used instead with appropriate changes to the mechanical elements and/or their orientation.

We claim:

1. An occupant support comprising:

a frame;

a deck comprising at least one deck section pivotably connected to the frame;

a lift system for changing an angular orientation of the at least one deck section in response to a mechanical user input, the lift system comprising a first bellcrank and a second bellcrank, the first bellcrank being pivotably attached to the frame, the first bellcrank having A) an input arm for receiving the user input and B) an output arm, the second bellcrank being pivotably attached to the frame and having an input leg and an output leg; and a transfer link having a first end connected to the output arm of the first bellcrank and a second end connected to the input leg of the second bellcrank; and a compression link having a bellcrank end connected to the output leg of the second bellcrank and a deck end connected to the deck;

wherein the first bellcrank has a vertical axis of rotation thereby being adapted to receive the user input in a horizontal plane at the input arm thereof, and in which the input produces a rotary motion of the second bellcrank about an axis nonparallel to the axis of rotation of the first bellcrank and in which the rotary motion of the second bellcrank causes the compression link to change the angular orientation of the at least one deck section.

2. The occupant support of claim 1 in which the user input is an angular user input.

3. The occupant support of claim 1 in which the at least one deck section comprises a first deck section pivotably connected to the frame and a second deck section pivotably connected to the first deck section such that a change of angular orientation of the first deck section causes a change of angular orientation of the second deck section.

4. The occupant support of claim 3 in which the first deck section is a thigh section and the second deck section is a calf section.

5. The occupant support of claim 1 including a lock for holding the at least one deck section at a desired angular orientation.

6. The occupant support of claim 1 wherein the user input is spatial displacement of a mechanical element.

7. An occupant support comprising:

a frame;

a deck comprising at least one deck section pivotably connected to the frame;

a lift system for changing an angular orientation of the at least one deck section in response to a mechanical user input, the lift system comprising a first bellcrank and a second bellcrank, the first bellcrank being pivotably attached to the frame, the first bellcrank having A) an input arm for receiving the user input and B) an output arm, the second bellcrank being pivotably attached to the frame and having an input leg and an output leg; and a transfer link having a first end connected to the output arm of the first bellcrank and a second end connected to the input leg of the second bellcrank;

wherein the first bellcrank has a vertical axis of rotation thereby being adapted to receive a user input in a horizontal plane at the input arm thereof, and in which the lift system produces a rotary motion of the second bellcrank about an axis nonparallel to the axis of rotation of the first bellcrank.

8. The occupant support of claim 7 comprising a compression link having a bellcrank end connected to the output leg of the second bellcrank and a deck end connected to the deck.

9. The occupant support of claim 8 wherein the rotary motion of the second bellcrank causes the compression link to change the angular orientation of the at least one deck section.

10. The occupant support of claim 7 in which the user input is an angular user input.

11. The occupant support of claim 7 in which the at least one deck section comprises a first deck section pivotably connected to the frame and a second deck section pivotably connected to the first deck section such that a change of angular orientation of the first deck section causes a change of angular orientation of the second deck section.

12. The occupant support of claim 11 in which the first deck section is a thigh section and the second deck section is a calf section.

13. The occupant support of claim 7 including a lock for holding the at least one deck section at a desired angular orientation.

14. The occupant support of claim 7 wherein the user input is spatial displacement of a mechanical element.

* * * * *